US005896642A

United States Patent [19]

Peker et al.

[11] Patent Number: 5,896,642

[45] Date of Patent: Apr. 27, 1999

[54] DIE-FORMED AMORPHOUS METALLIC ARTICLES AND THEIR FABRICATION

[75] Inventors: Atakan Peker, Aliso Viejo; Eric Bakke, Murrieta; William L. Johnson, Pasadena, all of Calif.

[73] Assignees: Amorphous Technologies International, Laguna Niguel; California Institute of Technology, Pasadena, both of Calif.

[21] Appl. No.: 08/683,319

[22] Filed: Jul. 17, 1996

[51] Int. Cl.[6] ..... B21K 17/00

[52] U.S. Cl. ..... 29/522.1; 72/700; 148/561; 473/342

[58] Field of Search ..... 72/364, 700; 29/522.1; 148/403, 561, 562; 473/342

[56] References Cited

U.S. PATENT DOCUMENTS

| | | | |
|---|---|---|---|
| 2,190,611 | 2/1940 | Sembdner | 29/522.1 |
| 4,529,457 | 7/1985 | Kushnick | 148/561 |
| 4,854,370 | 8/1989 | Nakamura . | |
| 5,117,894 | 6/1992 | Katahira . | |
| 5,288,344 | 2/1994 | Peker et al. . | |
| 5,296,059 | 3/1994 | Masumoto et al. . | |
| 5,306,463 | 4/1994 | Horimura . | |
| 5,312,495 | 5/1994 | Masumoto et al. . | |
| 5,324,368 | 6/1994 | Masumoto et al. . | |
| 5,390,724 | 2/1995 | Yamauchi et al. . | |
| 5,564,994 | 10/1996 | Chang | 473/342 |
| 5,589,012 | 12/1996 | Hobby et al. . | |

FOREIGN PATENT DOCUMENTS

| | | | |
|---|---|---|---|
| 0 4946 88 | 7/1992 | European Pat. Off. | 148/561 |

OTHER PUBLICATIONS

A. Kato et al., "Production of Bulk Amorphous $Mg_{85}Y_{10}Cu_5$ Alloy by Extrusion of Atomized Amorphous Powder," *Materials. Trans., JIM*, vol. 35, No. 2 (1994), pp. 125–129.

Y. Kawamura et al., "Full strength compacts by extrusion of glass metal powder at the supercooled liquid state," *Appl. Phys. Lett.*, vol. 67 (14) (1995), pp. 2008–2010.

"Metals Handbook", vol. 5, 8$^{th}$ edition, pp. 285–306 (1970).

A. Inoue et al., "Mg–Cu–Y Bulk Amorpohous Alloys with High Tensile Strength Produced by a High–Pressure Die Casting Method," *Materials Transactions, JIM*, vol. 33, No. 10, pp. 937–945 (1992).

A. Inoue et al., "Bulky La–A1–TM (TM=Transition Metal) Amorphous Alloys with High Tensile Strength Produced by a High–Pressure Die Casting Method," *Materials Transactions, JIM*, vol. 34, No. 4, pp. 351–358 (1993).

K. Amiya et al., "Mechanical strength and thermal stability of Ti–based amorphous alloys with large glass–forming ability," *Materials Science and Engineering*, A179/a180, pp. 692–696 (1994).

Interbike Buyer, 1995 Interbike Expos Show Catalog.

*Primary Examiner*—Lowell A. Larson
*Attorney, Agent, or Firm*—Gregory Garmong

[57] ABSTRACT

A metallic article is fabricated by providing a die and a piece of a bulk-solidifying amorphous metallic alloy having a glass transition temperature. The bulk-solidifying amorphous metallic alloy is heated to a forming temperature of from about 0.75 $T_g$ to about 1.2 $T_g$ and forced into the die cavity at the forming temperature under an external pressure of from about 260 to about 40,000 pounds per square inch, thereby deforming the piece of the bulk-solidifying amorphous metallic alloy to a formed shape that fills the die cavity. Preferably, a pressure is applied to the piece of the bulk-solidifying amorphous metallic alloy as it is heated, and the heating rate is at least about 0.1° C. per second. The die may be a male die or a female die. When the die has a re-entrant comer therein, the formed shape of the bulk-solidifying amorphous metallic alloy is mechanically locked to the die.

15 Claims, 4 Drawing Sheets

DIE-FORMED AMORPHOUS METALLIC ARTICLES AND THEIR FABRICATION

BACKGROUND OF THE INVENTION

This invention relates to the solidifying of metals, and, more particularly, to the die solidifying of amorphous metals.

Metallic articles are often formed to final or near-final shape by a die-forming operation using either an open or a closed die. In open-die forming, platens squeeze or pound a metal preform, which is allowed to expand laterally without limit. In closed-die forming, the metal preform is pressed between two dies, at least one of which is shaped in a manner so that the metal preform expands laterally to fill the die.

The present inventors have determined that bulk-solidifying amorphous metallic alloys are potentially amenable to the use of die-forming techniques. Such materials exhibit an amorphous metallic structure in thick sections in the solid state. However, their constitutive relations and deformation properties differ from those of crystalline metals. The techniques that are used for the die forming of crystalline metals may not be applicable to the die forming of amorphous metals, or may require modification or optimization when applied to the die forming of bulk-solidifying amorphous metals.

Accordingly, there is a need for an approach for the die forming of bulk-solidifying amorphous metals that is selected to take advantage of the properties of these metals. The present invention fulfills this need, and further provides related advantages.

SUMMARY OF THE INVENTION

The present invention provides an approach for the die forming of bulk-solidifying amorphous metallic alloys, and die-formed amorphous metallic articles. This approach may be used for the die forming of a wide variety of shapes. Some of the same apparatus as used for the die forming of conventional crystalline articles may be used in the die forming of bulk-solidifying amorphous metals, although the procedures differ.

In accordance with the invention, a method for fabricating a metallic article comprises the steps of providing a die with a die cavity, and providing a piece of a bulk-solidifying amorphous metallic alloy having a glass transition temperature $T_g$. The method further includes heating the bulk-solidifying amorphous metallic alloy to a forming temperature and forcing the piece of the bulk-solidifying amorphous metallic alloy into the die cavity at the forming temperature, thereby deforming the piece of the bulk-solidifying amorphous metallic alloy to a formed shape that substantially fills the die cavity.

The forming temperature is from about 0.75 $T_g$ to about 1.2 Tg, where $T_g$ is measured in 0° C. More preferably, the forming temperature is from about 0.75 $T_g$ to about 0.95 $T_g$, The externally applied pressure as the amorphous metal is forced into the die is from about 260 to about 40,000 pounds per square inch, preferably from about 1,000 to about 40,000 pounds per square inch.

The die forming is accomplished with a bulk-solidifying amorphous alloy. Bulk-solidifying amorphous alloys are a class of amorphous alloys that can retain their amorphous structures when cooled at rates of about 500° C. per second or less, depending upon the alloy composition. Bulk-solidifying amorphous alloys have been described, for example, in U.S. Pat. No. 5,288,344 and 5,368,659, whose disclosures are incorporated by reference.

Surprisingly, the viscosity of the bulk-solidifying amorphous metal is a function of both the loading state of the amorphous metal as it is heated to the die-forming temperature and the rate of heating to the die-forming temperature. When the bulk-solidifying amorphous metal is heated in the presence of an applied load for at least the latter portion of the heating prior to reaching the die-forming temperature, the viscosity is lower at the die-forming temperature than is the case when the metal is heated without an applied loading. Also, when the metal is heated to the die-forming temperature relatively rapidly, the resulting non-equilibrium viscosity is lower than the viscosity at the same temperature when the metal is heated relatively slowly, which is an advantage in the processing.

The present approach is applicable for a wide variety of die-forming operations, using both open and closed dies. The dies may be either male or female. The dies may be part-forming dies or flow-through dies such as extrusion dies.

In one application, the piece of the bulk-solidifying amorphous metallic alloy is used as an insert at the surface of a substrate article, to impart particular properties to that region of the surface. In this case, a recess in the surface of the substrate article serves as the die cavity. The die has a re-entrant interior comer, and the bulk-solidifying amorphous metallic alloy is forced into the die and thence into re-entrant interior comer in the die-forming operation. The formed shape of the bulk-solidifying amorphous metallic alloy is thereby mechanically locked to the die.

The present invention thus provides a method for die forming bulk solidifying amorphous alloys, and die-formed articles. Other features and advantages of the present invention will be apparent from the following more detailed description of the preferred embodiment, taken in conjunction with the accompanying drawings, which illustrate, by way of example, the principles of the invention.

DETAILED DESCRIPTION OF THE INVENTION

Figure 1:
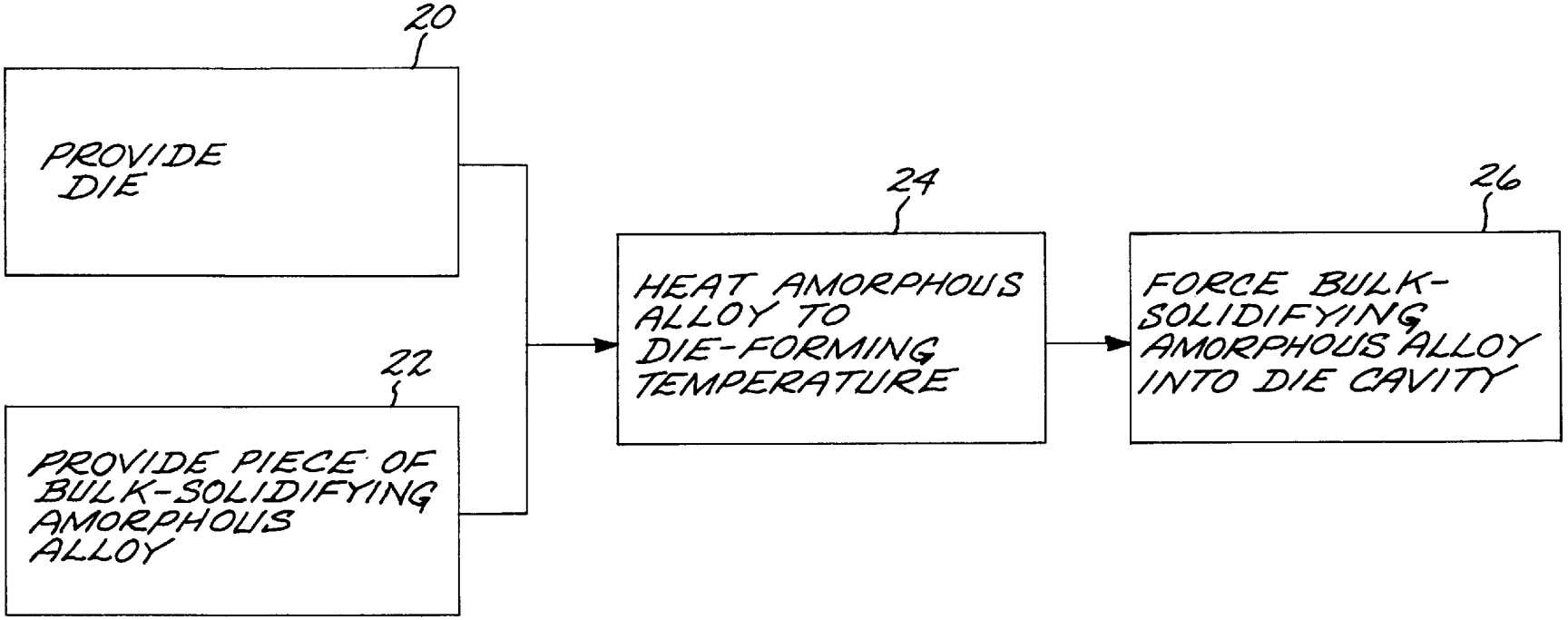
FIG. 1 is a block flow diagram of a method according to the present invention.

FIG. 1 is a block flow diagram of a method for fabricating a metallic article of a bulk-solidifying amorphous alloy using a die. A die is provided, numeral 20. Examples of some operable dies are illustrated in FIGS. 2–5, but the use of the invention is more broadly applicable to other configurations of dies as well.

Figure 2:
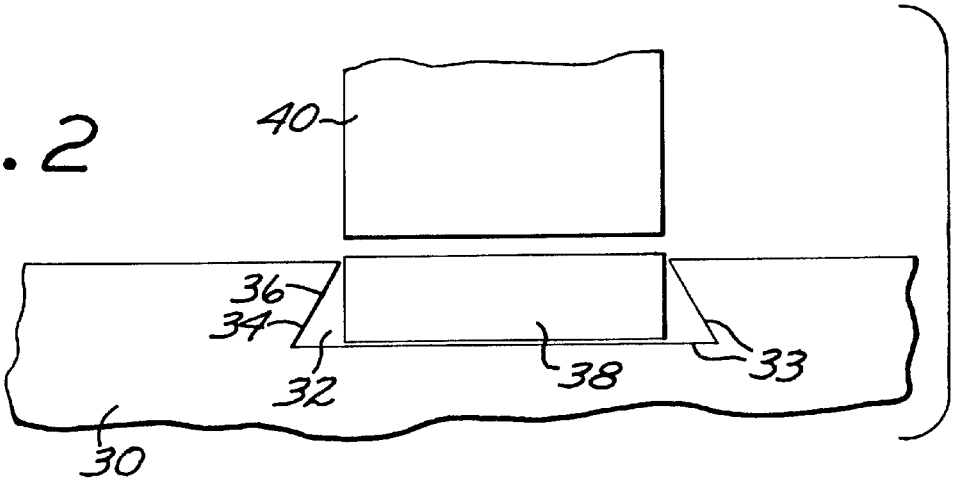
FIG. 2 is a schematic side sectional view of a male pressing die, a female die with a re-entrant interior comer, and a piece of the bulk-solidifying amorphous metallic alloy positioned within the female die prior to die forming.

A die 30 of FIG. 2 is a female die having a die cavity 32 in the form of a recess in the die. The forming surfaces 33 against which the amorphous metallic alloy is formed define the die cavity 32, among other features. The die cavity 32 in this case has a re-entrant corner 34 formed by tapering the sides 36 of the die cavity 32 outwardly with increasing distance from the die entry. The re-entrant corner 34 could also be formed by a stepwise tapering of the sides, a rounded outward tapering of the sides, or any other operable geometry. The results obtained when the die recess has such a re-entrant corner will be discussed subsequently in relation to FIGS. 5A, 5B, and 6. The sides 34 of the die cavity 32 could also be straight, inwardly tapered, or of other operable geometry. A piece 38 of the bulk-solidifying amorphous metal alloy to be pressed into the die 30 is illustrated in position within the die 30 prior to die forming. A male pressing head 40 subsequently forces the piece 38 into the female die 30 to conform to the shape of the die cavity 32 and substantially fill the die cavity, including the re-entrant corner 34.

Figure 3:
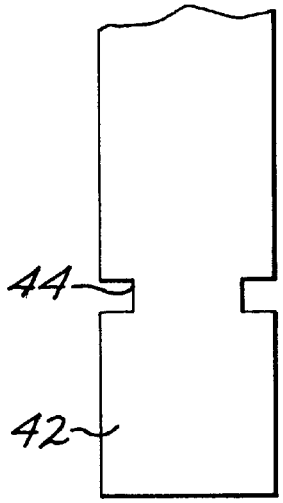
FIG. 3 is a schematic side sectional view of a male punch die with a re-entrant comer.

A die 42 shown in FIG. 3 is a male die which also has re-entrant corners 44. As with the die 30, the die 42 could have other operable shapes as well.

Figure 4:
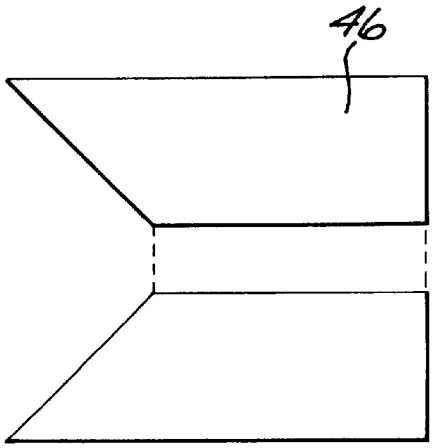
FIG. 4 is a schematic side sectional view of an extrusion die.

A die 46 shown in FIG. 4 is an extrusion die. Metal is forced through the die 46, from left to right in the illustration. The cross-sectional area of the metal is reduced as it flows through the die 46.

A piece of a bulk-solidifying amorphous metallic alloy is provided, numeral 22. The amorphous alloy is a metal alloy that may be cooled from the melt to retain the amorphous form in the solid state, termed herein a "bulk solidifying amorphous metal". Such metals can be cooled from the melt at relatively low cooling rates, on the order of about 500° C. per second or less, yet retain an amorphous structure after cooling. These bulk-solidifying amorphous metals do not experience a liquid/solid crystallization transformation upon cooling, as with conventional metals. Instead, the highly fluid, non-crystalline form of the metal found at high temperatures becomes more viscous as the temperature is reduced, eventually taking on the outward physical properties of a conventional solid.

This ability to retain an amorphous structure even with a relatively slow cooling rate is to be contrasted with the behavior of other types of amorphous metals that require cooling rates of at least about $10^4$–$10^{6°}$ C. per second from the melt to retain the amorphous structure upon cooling. Such metals can only be fabricated in amorphous form as thin ribbons or particles. Such a metallic material cannot be prepared in the thicker sections required for typical articles of the type produced by die forming.

Even though there is no liquid/solid crystallization transformation for a bulk-solidifying amorphous metal, a "melting temperature", $T_m$, may be defined as the temperature at which the viscosity of the metal falls below $10^2$ poise upon heating. It is convenient to have such a $T_m$ reference to describe a temperature above which the viscosity of the material is so low that, to the observer, it apparently behaves as a freely flowing liquid material.

Similarly, an effective "freezing temperature", $T_g$ (often referred to as the glass transition temperature), may be defined as the temperature below which the equilibrium viscosity of the cooled liquid is above $10^{13}$ poise. At temperatures below $T_g$, the material is for all practical purposes a solid. For the zirconium-titanium-nickel-copper-beryllium alloy family of the preferred embodiment, $T_g$ is in the range of about 310–400° C. and T. is in the range of about 660–800° C. (An alternative approach to the definition and determination of $T_g$ used in some other situations is based upon measurements by differential scanning calorimetry, which yields different ranges. For the present application, the above definition in terms of viscosity is to be used.) At temperatures in the range between $T_m$ and $T_g$, the viscosity of the bulk-solidifying amorphous metal increases slowly and smoothly with decreasing temperature.

A preferred bulk-solidifying amorphous metallic alloy has a composition range, in atom percent, of from about 45 to about 67 percent total of zirconium plus titanium, from about 10 to about 35 percent beryllium, and from about 10 to about 38 percent total of copper plus nickel. A substantial amount of hafnium can be substituted for some of the zirconium and titanium, aluminum can be substituted for the beryllium in an amount up to about half of the beryllium present, and up to a few percent of iron, chromium, molybdenum, or cobalt can be substituted for some of the copper and nickel. These bulk-solidifying alloys are known and are described in U.S. Pat. No. 5,288,344. One most preferred such metal alloy material of this family has a composition, in atomic percent, of about 41.2 percent zirconium, 13.8 percent titanium, 10 percent nickel, 12.5 percent copper, and 22.5 percent beryllium. It has a liquidus temperature of about 720° C. and a tensile strength of about 1.9 GPa. Another most preferred metallic alloy of this family has a composition, in atomic percent, of about 46.75 percent zirconium, 8.25 percent titanium, 10.0 percent nickel, 7.5 percent copper, and 27.5 percent beryllium.

Another known type of bulk-solidifying amorphous alloy materials has a composition range, in atom percent, of from about 25 to about 85 percent total of zirconium and hafnium, from about 5 to about 35 percent aluminum, and from about 5 to about 70 percent total of nickel, copper, iron, cobalt, and manganese, plus incidental impurities, the total of the percentages being 100 atomic percent. A most preferred metal alloy of this group has a composition, in atomic percent, of about 60 percent zirconium about 15 percent aluminum, and about 25 percent nickel. This alloy family is less preferred than that described in the preceding paragraph.

Bulk-solidifying amorphous metallic alloys are characterized by an absence of a crystalline structure, an absence of grains, and an absence of grain boundaries. Consequently, the surface of the as-die-formed bulk-solidifying amorphous alloy is of high quality and quite smooth, when die formed against a high-quality, smooth surface of the die cavity. Excellent surface quality is achieved by making the forming surface 33 of the die—the surface contacted by the amorphous piece—very smooth. Preferably, the internal forming surface of the die has a surface roughness of less than about 3 microinches RMS. The smooth forming surface 33 is achieved by careful mechanical and/or chemical polishing of the forming surface 33. It is preferred that the die, and especially the portion of the die that forms the forming surface 33, be made of a steel that is highly resistant to heat checking, such as H-11 or HR-13 tool steels or a maraging steel. The forming surface 33 may also be made of, or coated with, an amorphous alloy that itself has no grain boundaries and is very smooth. Suitable amorphous alloys include high-phosphorus electroless nickel or an amorphous electrolytic cobalt-tungsten-boron alloy described in U.S. Pat. No. 4,529,668, whose disclosure is incorporated herein.

A further advantage of using bulk-solidifying amorphous metallic alloys for die forming lies in their low surface coefficient of friction, which alters the nature of the die-forming operation itself. In conventional die-forming operations, the forming surface 33 must be lubricated with a lubricant such as an oil, a silicone, or a graphite particulate between each die-forming operation. The need for lubrication increases the cost of the process through both the cost of the lubricant and the time and equipment required to accomplish the lubrication. When bulk-solidifying amorphous alloys are used in die forming, lubrication of the forming surface 33 is not required in most cases. The absence of lubrication in the present approach results in a further improvement to the surface finish and soundness of the die-formed article, inasmuch as the chemical breakdown of the lubricant adversely affects surface finish. Additionally, the decomposition products of the lubricant may pose a workplace health hazard, and the present approach eliminates this problem.

The piece 38 of the bulk-solidifying amorphous alloy is heated to a die-forming temperature, numeral 24. Heating typically is from room (ambient) temperature to the die-forming temperature. This heating from a lower temperature to the processing temperature distinguishes the present approach from die casting, where the metal is cooled from a higher temperature to the processing temperature.

The die-forming temperature is from about 0.75 $T_g$ to about 1.2 $T_g$, where $T_g$ is measured in 0° C., which for the preferred amorphous alloy is from about 240° C. to about 385° C. The deformation behavior of the bulk-solidifying metallic alloy can best be described by its viscosity 1, which is a function of temperature. At temperatures below about 0.75 $T_g$, the viscosity is very high. Die forming below about 0.75 $T_g$ requires such high applied pressures that the dies may be damaged or subjected to excessive wear, the time to complete the die forming is excessively long, and the bulk-solidifying amorphous metallic alloy may not fill the die cavity completely where the die is a female die with relatively finely defined interior features. At die-forming temperatures higher than about 1.2 $T_g$, the viscosity is low and die forming is easy, but there is a tendency to crystallization of the alloy during die forming, so that the benefits of the amorphous state are lost. Additionally, at die-forming temperatures above 1.2 $T_g$ there is a tendency toward embrittlement of the alloy, which is believed to be due to a spinoidal decomposition reaction. It is preferred that the die-forming temperature be at the lower end of the range of about 0.75 $T_g$ to about 1.2 $T_g$, to minimize the possibility of embrittlement. Thus, a minimum die-forming temperature of about 0.75 $T_g$ and a maximum die-forming temperature of about 0.95 $T_g$ are preferred to minimize the incidence of embrittlement and also to permit the final die-formed article to be cooled sufficiently rapidly to below the range of any possible embrittlement, after die-forming is complete.

The operable range may instead be expressed in terms of the viscosities of the bulk-solidifying amorphous metallic alloy which are operable.

The step 24 of heating is preferably accomplished with a load applied to the piece of the bulk-solidifying amorphous metallic alloy that is to be die formed, at least as the temperature approaches the die-forming temperature. Studies have shown that heating with an applied load results in a lower viscosity at the die-forming temperature than heating without an applied load.

The step 24 of heating is also preferably accomplished relatively rapidly rather than in a slow, equilibrium manner. FIG. 7 illustrates the viscosity $\eta$of a bulk-solidifying amorphous metallic alloy within the preferred composition range as a function of temperature, for slow (equilibrium) heating from room temperature to the die-forming temperature, and for two faster heating rates. The faster heating rates, above about 0.1° C. per second, result in substantially reduced viscosity at temperatures in the range of about 0.75 $T_g$ to about 1.2 $T_g$. The lower viscosity permits the die forming to be accomplished with lower forming loads, resulting in a lesser requirement for press capability and reducing the potential damage to the die-forming die, which may be important in some cases. Die forming may also be accomplished with non-conventional dies, as will be discussed in relation to FIG. 6.

Figure 5A:
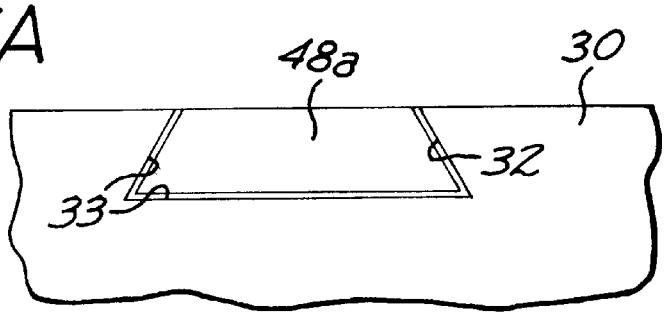
FIG. 5A is a schematic side sectional view of the die of FIG. 2 after die forming is complete and wherein the amount of the bulk-solidifying amorphous metallic alloy is selected to just fill the die.
Figure 5B:
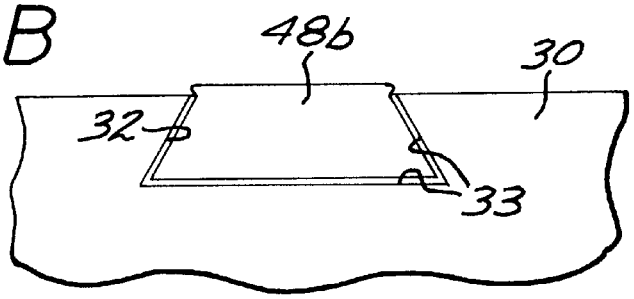
FIG. 5B is a schematic side sectional view of the die of FIG. 2 after die forming is complete and wherein the amount of the bulk-solidifying amorphous metallic alloy is selected to be larger than that required to fill the die.

The piece 38 of the bulk-solidifying amorphous alloy is forced into the die cavity, numeral 26, to alter its shape to conform to that defined by the forming surface 33. In the case of the female die 30, the piece 38 is forced into the interior of the die cavity 32. FIGS. 5A and 5B illustrate the result, with the formed shape 48 of the piece 38 within the die cavity 32 of the die 30. In practice, the formed shape 48 conforms very closely to that of the forming surface 33 and there is a tight contact between the formed shape and the forming surface, but in FIGS. 5A and 5B a slight gap therebetween is present for purposes of illustration. In the process whose result is shown in FIG. 5A, the volume of metal in the formed shape 48*a* was selected to just fill the die cavity 32, while in FIG. 5B the die cavity is filled and there is also a small excess of metal in the formed shape 48*b* above the volume of the die cavity 32, so that the excess protrudes out of the die cavity 32. In both of the embodiments of FIGS. 5A and 5B, the formed shape 48 is mechanically locked to the die in a permanent manner due to the presence of the re-entrant corner, and it cannot be removed without destroying either the formed shape 48 or the die.

As described in U.S. Pat. No. 5,324,368, in the past it has been known to deform thin sheets of amorphous alloys into recesses at temperatures between $T_g$ and $T_m$, with small applied pressures of about 50 pounds per square inch (psi) or less. This processing, essentially a blow molding, is not of the same nature as the present approach. In the procedure of the '368 patent, the final thickness of the piece of amorphous metal is less than, usually much less than, the associated depth of the recess. In the present approach, by contrast, the final thickness of the piece of amorphous metal after die-forming is complete is substantially the same as the corresponding internal dimension of the die, because the metal fills the die cavity. The deformation in the approach of the '368 patent is therefore largely in a bending mode, and it is therefore possible to use small applied pressures. In the present approach, however, bulk deformation of the relatively thick amorphous alloy piece is required to force the amorphous metal into contact with the internal surface throughout the die cavity.

Therefore, the external pressure (force per unit area) applied in the step of forcing must be sufficiently high to accomplish the filling of the die cavity in an acceptable time and also to achieve penetration of the metal into relatively fine features of the die cavity, where present. (This "external pressure" is the pressure externally applied through the die-forming apparatus as measured by the applied force of the press divided by the effective area, not the stress within the piece of amorphous metal being deformed.) Although the requirements vary according to the resolution of features in the die, as a general rule the external pressure should be sufficient for the amorphous metal to flow into features 1 micrometer in width. The minimum externally applied pressure is therefore about 260 pounds per square inch (psi) in order to achieve this resolution. The externally applied pressing pressure required to fill a feature with the amorphous metal is approximately proportional to 1/W, where W is the width of the feature. Higher externally applied pressing pressures are therefore required in order to fill finer features, and lower externally applied pressing pressures are required in order to fill coarser features. More preferably, the minimum externally applied pressing pressure is about 1000 psi in order to achieve filling of the die-forming die within a reasonable period of time. There is no fixed maximum externally applied pressing pressure, but in general the external pressure should not be so high as to damage the die-forming mold. A practical maximum for most circumstances is about 40,000 psi.

Thus, with the present approach, after die-forming is complete the formed shape of the amorphous alloy piece substantially completely fills the interior of the die cavity. Bulk deformation, not just bending deformation, is required to achieving such filling of the die cavity.

At the conclusion of the forcing step 26, the die-formed article is cooled to a lower temperature, preferably to room temperature, as quickly as is reasonably possible to avoid possible embrittlement effects. If the article is not joined to the die, it is removed from the die and rapidly cooled. In the case to be described next where the die-formed article is mechanically locked to the die, both the die-formed article and the die are cooled rapidly. Preferably, the die-formed article and/or die are quenched into water after die forming is complete.

In a particularly preferred embodiment of the present invention, die forming is used to permanently fasten two articles together. Some golf club heads comprise a head body with a face plate insert fastened to the face of the body. In an advanced club head under development by the assignee of the present invention, the head body is formed of a conventional crystalline metallic material, and the face plate is a piece of a bulk-solidifying amorphous metallic alloy. One approach for fastening the face plate to the body of the golf club head is to use mechanical fasteners, such as screws, but this is undesirable because the fasteners could loosen or could adversely affect the functioning of the golf club.

Figure 6:
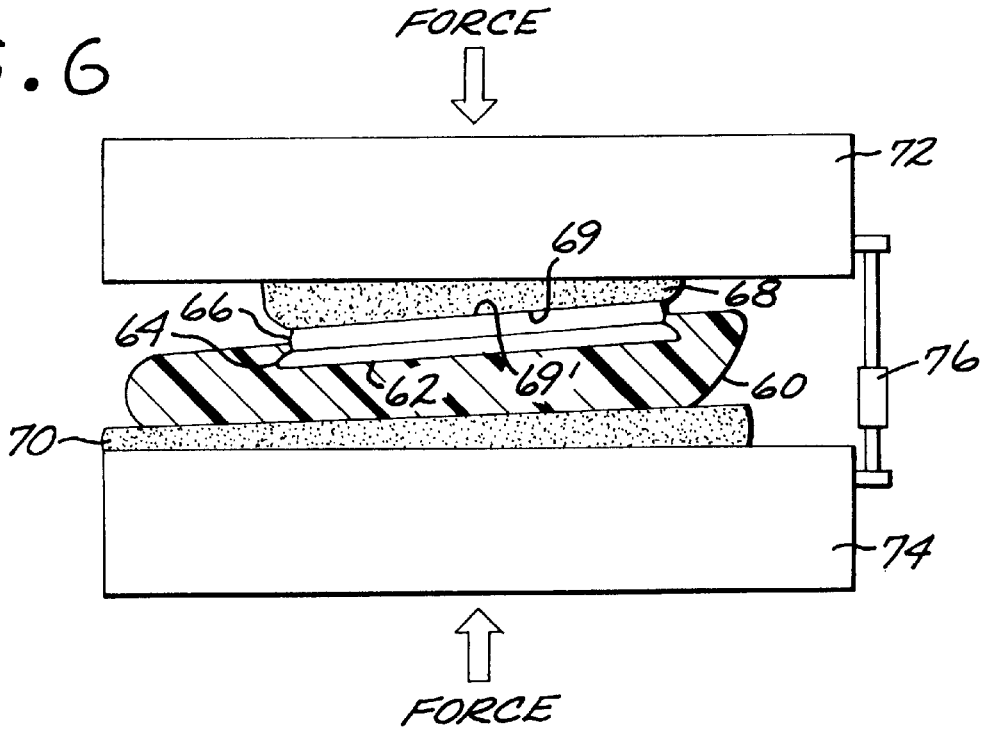
FIG. 6 is a side elevational view for forming a golf club head with an insert of a bulk-solidifying amorphous alloy at the club head face.
Figure 7:
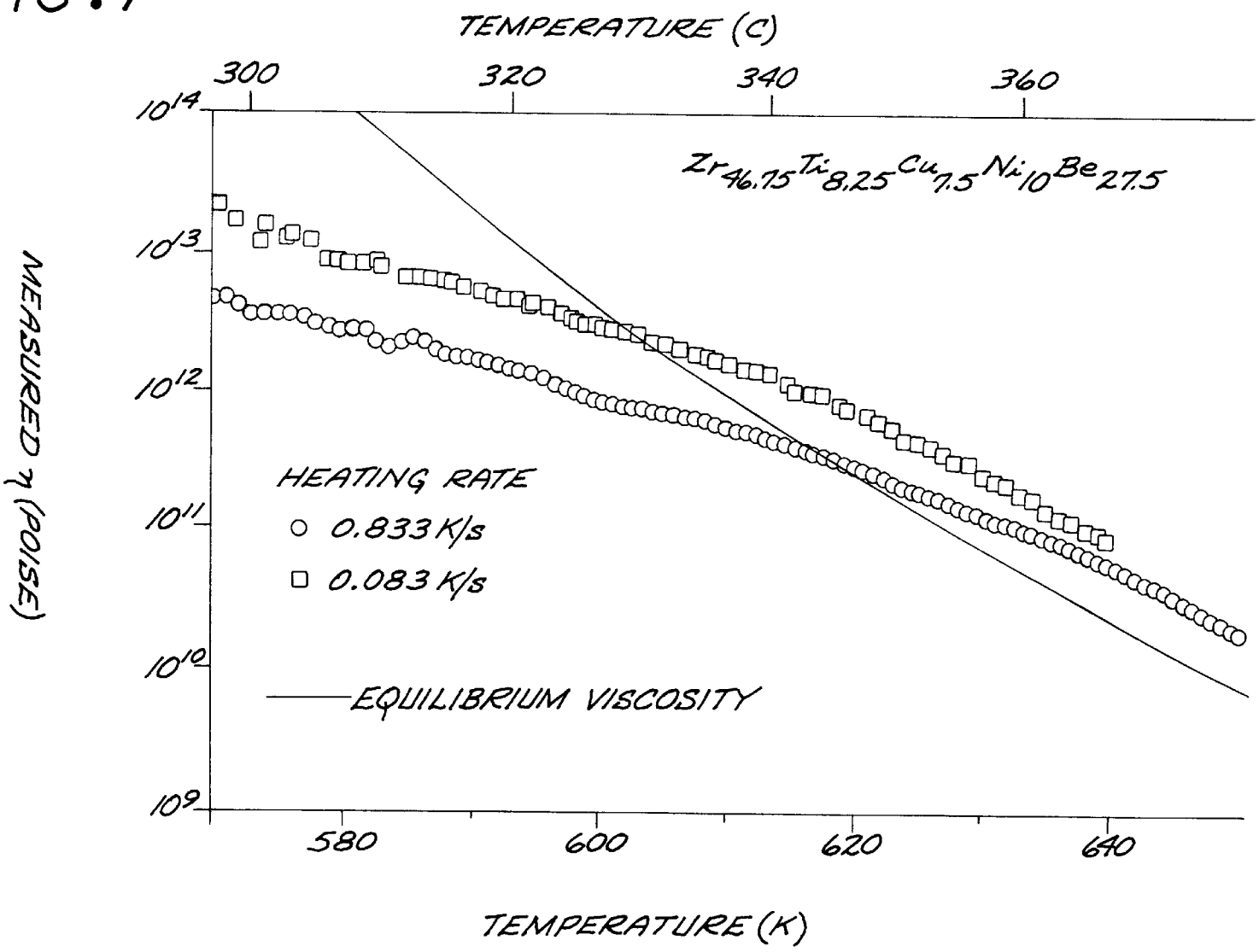
FIG. 7 is a graph of viscosity of a bulk-solidifying amorphous metallic alloy as a function of temperature.

According to the present approach, as illustrated in FIG. 6, the re-entrant corner in the die is used to create a mechanical locking engagement to permanently and soundly join the die and the formed shape of amorphous metal, the face plate insert. A golf club head body 60 has a recess 62 therein, which function as the die 30 and die cavity 32, respectively, of FIG. 2. A re-entrant corner 64 is machined into the die cavity 32. A piece 66 of the bulk-solidifying amorphous metallic alloy is placed into the die cavity 32.

Because the golf club head body 60 is not in the form of a rectangular solid with parallel faces, conforming metal fixturing blocks 68 and 70 are placed on the top and bottom, respectively, of the golf club head body 60. The top fixturing block 68 contacts the piece 66 of the bulk-solidifying amorphous metallic alloy, so that during the die forming operation the fixturing block 68 serves as the pressing head to apply the externally applied pressing pressure to the piece of amorphous metal, and the bottom block contacts the golf club head body 60. A face 69 of the top fixturing block 68 which contacts the piece 66 is prepared to be very smooth in the manner discussed previously, because the corresponding face 69' of the piece 66 is the exposed face of the finished golf club that impacts the golf ball. Irregularities such as scratches in the face 69 are transferred to the final face 69' of the piece 66, and could be detrimental to the functioning of the golf club head. The face 69 may be made of the same material as the remainder of the block 68, or it may be provided as a separate plate that lies between the body of the block 68 and the piece 66. In the latter case, the plate is preferably made of a material that is a good heat conductor, such as copper or a copper alloy, to distribute the heat uniformly to the piece 66 and accelerate its heating.

Oppositely disposed pressing platens 72 and 74 of a die-forming press contact the respective fixturing blocks 68 and 70. Heating of the amorphous metallic piece 66 and the golf club head body is accomplished by any operable approach, with the use of heated platens preferred. Alternatives such as the use of a furnace around the apparatus are acceptable. Force is applied through the platens 72 and 74, and thence through the fixturing blocks 68 and 70, to force the piece 66 into the die cavity 62. The separation of the platens 72 and 74 is measured, preferably with a linear displacement transducer 76, as an indication of the extent of the deformation of the piece 66 into the die cavity 62. The heating 24 and forcing 26 steps of FIG. 1 are performed using this apparatus.

Upon completion of the forcing step 26, the formed shape corresponding to the piece 66 is permanently joined to the golf club head body 60 by mechanical interlocking of the deformed shape of the piece 66 to the re-entrant corners 64, without the use of fasteners or other devices which could become loose during service or could interfere with the functioning of the golf club.

The following examples illustrate aspects of the present technology, but should not be interpreted as limiting of the scope of the invention in any respect.

EXAMPLE 1

The present approach has been practiced using the approach of FIG. 1 and the apparatus of FIG. 6, to prepare a golf club head with a face piece insert permanently joined thereto. The bulk-solidifying amorphous metal alloy piece had a composition, in atomic percent, of 41.2 percent zirconium, 13.8 percent titanium, 10 percent nickel, 12.5 percent copper, and 22.5 percent beryllium. The golf club head body 60 was made of 17-4 PH steel in the shape shown in FIG. 6.

The fixturing blocks 68 and 70 were made of steel, with a copper plate affixed to the top block 68 and providing the face 69. The fixturing blocks 68 and 70 oriented the golf club head body 60 as shown in FIG. 6, with the direction of applied external pressing pressure vertical. A compressive preload of 1000 pounds (over an area of about 4.4 square inches for the amorphous alloy piece of the example) was applied through the platens 72 and 74, and the heating step 24 was commenced. After 27-½ minutes of heating, the compressive preload was increased to 2100 pounds. After another 8 minutes (36 minutes total elapsed time), the golf club head body and the amorphous piece had reached the die-forming temperature of 320–340° C. The loading was thereafter slowly increased to 16,000 pounds over a period of three minutes (39 minutes total elapsed time). As the loading was increased, the linear displacement transducer registered a movement of about 0.07 inches. The temperature and loading were maintained for 1-½ minutes, and the platen heaters were turned off. Four minutes later the platens were retracted, and the club head assembly was placed into water at room temperature. The face plate insert was found to be firmly set into the club head.

EXAMPLE 2

The procedure of Example 1 was repeated, except that the fixturing blocks 68 and 70 were both all-steel in construction and that the pressure-loading cycle was altered slightly.

The method of Example 1 was followed, except that the preload was 13,000 pounds from the beginning of the heating cycle. At 22-½ minutes after the start of heating, the loading was increased to 16,000 pounds. After 9 more minutes (31-½ minutes total elapsed time), the golf club head body and amorphous material had reached the die-forming temperature of 320–340° C., and the linear displacement transducer began indicating movement. At 34 minutes total elapsed time, the heaters were shut off. At 35-½ minutes total elapsed time, the platens were retracted, and the club head assembly was placed into water at room temperature. The total movement of the linear displacement transducer was 0.065 inches. As in Example 1, the face plate insert was found to be firmly set into the club head.

The present invention thus provides an approach to the manufacture of die-formed articles. Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A method for fabricating a metallic article, comprising the steps of providing a die having an interior die cavity therein;

providing a piece of a bulk-solidifying amorphous metallic alloy having a glass transition temperature $T_g$;

heating the piece of the bulk-solidifying amorphous metallic alloy from a lower temperature to a die-forming temperature with a load simultaneously applied to the bulk-solidifying amorphous metallic alloy during at least a portion of the step of heating; and forcing the piece of the bulk-solidifying amorphous metallic alloy into the die cavity at the forming temperature, thereby deforming the piece of the bulk-solidifying amorphous metallic alloy to a formed shape that substantially fills the die cavity.

2. The method of claim 1, wherein the step of providing a die includes the step of providing a die having a re-entrant interior corner, and wherein the step of forcing the bulk-solidifying amorphous metallic alloy into the die includes the step of;

forcing the bulk-solidifying amorphous metallic alloy into the re-entrant interior corner, thereby mechanically locking the formed shape of the bulk-solidifying amorphous metallic alloy to the die.

3. The method of claim 2, wherein the step of providing a die comprises the step of providing an article having a recess therein, the recess serving as the die cavity, to which the formed shape of the bulk-solidifying metallic amorphous metallic alloy is to be engaged.

4. The method of claim 3, wherein the step of providing an article having a recess therein comprises the step of providing a golf club head body having a recess therein.

5. The method of claim 1, wherein the step of providing a die includes the step of providing an extrusion die.

6. The method of claim 1, wherein the step of providing a die includes the step of providing a male die.

7. The method of claim 1, wherein the step of providing a die includes the step of providing a female die.

8. The method of claim 1, wherein the step of providing a bulk-solidifying amorphous metal includes the step of providing a bulk-solidifying amorphous alloy having a composition, in atomic percent, of from about 45 to about 67 percent total of zirconium plus titanium, from about 10 to about 35 percent beryllium, and from about 10 to about 38 percent total of copper plus nickel, plus incidental impurities, the total of the percentages being 100 atomic percent.

9. The method of claim 1, wherein the step of providing a bulk-solidifying amorphous metal includes the step of providing a bulk-solidifying amorphous alloy having a composition, in atomic percent, of from about 25 to about 85 percent total of zirconium and hafnium, from about 5 to about 35 percent aluminum, and from about 5 to about 70 percent total of nickel, copper, iron, cobalt, and manganese, plus incidental impurities, the total of the percentages being 100 atomic percent.

10. The method of claim 1, wherein the step of heating includes the step of heating the bulk-solidifying amorphous alloy at a rate of at least about 0.1° C. per second.

11. The method of claim 1, wherein an external pressure applied in the step of forcing is from about 260 pounds to about 40,000 pounds per square inch.

12. The method of claim 1, wherein the step of heating includes the step of heating the amorphous metallic alloy to a die-forming temperature of from about 0.75 $T_g$ to about 1.2 Tg, where $T_g$ is measured in °C.

13. The method of claim 1, wherein the step of forcing includes the step of providing a solid pressing head, and;

pressing the solid pressing head against the piece of the bulk-solidifying amorphous metallic alloy.

14. The method of claim 1, wherein the step of heating includes the step of heating the amorphous metallic alloy to a die-forming temperature of from about 0.75 $T_g$ to about 0.95 $T_g$, where $T_g$ is measured in °C.

15. A method for fabricating a metallic article, comprising the steps of providing a golf club head body having a recess therein with a re-entrant corner, the recess serving as a die cavity;

providing a piece of a bulk-solidifying amorphous metallic alloy having a glass transition temperature $T_g$;

heating the bulk-solidifying amorphous metallic alloy from a lower temperature to a forming temperature of from about 0.75 $T_g$ to about 1.2 $T_g$, where $T_g$ is measured in °C.; and forcing the piece of the bulk-solidifying amorphous metallic alloy to conform to the shape of the recess at the forming temperature, thereby deforming the piece of the bulk-solidifying amorphous metallic alloy to a formed shape which is mechanically locked to the golf club head body.

* * * * *